US010704856B1

(12) United States Patent
Clyncke

(10) Patent No.: US 10,704,856 B1
(45) Date of Patent: Jul. 7, 2020

(54) PROTECTIVE COVER FOR A LIGHTENING PORT

(71) Applicant: Owen Clyncke, Boulder, CO (US)

(72) Inventor: Owen Clyncke, Boulder, CO (US)

( * ) Notice: Subject to any disclaimer, the term of this patent is extended or adjusted under 35 U.S.C. 154(b) by 0 days.

(21) Appl. No.: 16/439,895

(22) Filed: Jun. 13, 2019

(51) Int. Cl.
*F41A 35/02* (2006.01)
*F41C 3/00* (2006.01)

(52) U.S. Cl.
CPC ..... *F41A 35/02* (2013.01); *F41C 3/00* (2013.01)

(58) Field of Classification Search
CPC ..... F41A 35/02; F41C 3/00
See application file for complete search history.

(56) References Cited

U.S. PATENT DOCUMENTS 4,534,264 A * 8/1985 Tarnoff ..... F41A 21/28 89/14.3
4,942,801 A * 7/1990 Schuemann ..... F41A 21/28 89/14.3
5,195,226 A 3/1993 Bornancini
5,423,242 A * 6/1995 Schuemann ..... F41A 21/28 89/14.3
5,563,362 A * 10/1996 York ..... F41A 21/36 89/14.3
5,918,401 A * 7/1999 Rowlands ..... F41A 35/02 42/14
8,528,243 B1 9/2013 Glock
8,915,174 B1 * 12/2014 Heizer ..... F41A 21/06 89/14.3
9,341,429 B1 5/2016 Reavis
D777,287 S * 1/2017 Scott ..... D22/108
D777,288 S * 1/2017 Scott ..... D22/108
9,970,728 B1 5/2018 Huang
9,995,544 B1 * 6/2018 Akimov ..... F41A 3/72
10,422,604 B2 * 9/2019 Niswander ..... F41A 3/66
2004/0226211 A1 11/2004 Keeney
2005/0016051 A1 1/2005 Fischbach
2005/0279789 A1 * 12/2005 Lowe ..... F41C 33/0209 224/244
2012/0159831 A1 6/2012 LaFrance
2014/0053445 A1 * 2/2014 Wolf ..... F41A 3/12 42/14

(Continued)

OTHER PUBLICATIONS

New Products: Glock G43X & G48, Zev OZ9 Pistol; https://www.youtube.com/watch?v=YGT7o3-vCbk; Feb. 7, 2019; Brownell (Year: 2019).*

*Primary Examiner* — Joshua E Freeman
(74) *Attorney, Agent, or Firm* — Arno Naekel

(57) ABSTRACT

Methods, devices and systems are provided for protecting a firearm. The device and system include a protective insert for a rectangular port in a firearm, the port having a length, a width and a vertical thickness. The protective insert comprises a rectangular plate having a top, an underside, two longitudinal sides, and two ends, each longitudinal side and each end having a length sized to allow the plate to freely ride vertically within the thickness of the port. The Protective insert also includes two parallel wing walls, each of the wing walls being perpendicularly attached to the underside of the plate and along a longitudinal side edge of the plate, wherein each wing wall extends beyond both of the plate ends and under the slide when installed. The protective insert fills the port in the slide and rides on, and is held in place, by the barrel when in operation.

20 Claims, 6 Drawing Sheets

(56) References Cited

U.S. PATENT DOCUMENTS

| | | | | |
|---|---|---|---|---|
| 2015/0129470 | A1 | 5/2015 | Troy | |
| 2017/0205178 | A1* | 7/2017 | Niswander | F41A 21/36 |
| 2017/0343312 | A1 | 11/2017 | Tamir | |
| 2018/0058792 | A1* | 3/2018 | Schirmer | F41A 21/28 |
| 2018/0306536 | A1* | 10/2018 | Ellis | F41A 3/36 |
| 2018/0347933 | A1 | 12/2018 | Molina | |
| 2018/0356177 | A1* | 12/2018 | Scott | F41A 35/02 |
| 2019/0257620 | A1* | 8/2019 | Zimmer | F41C 3/00 |

* cited by examiner

PROTECTIVE COVER FOR A LIGHTENING PORT

TECHNICAL FIELD

The present invention generally relates to firearms, and more specifically to methods, systems and devices for protecting a firearm from water, dirt and debris entering the firearm through a lightening port cut out of a surface of the firearm by the manufacturer to reduce weight.

BACKGROUND

Firearms vary in barrel length. Typically the longer the barrel the longer the sight radius and the more muzzle velocity you get from the propellant. However, the longer that the barrel is the longer the slide tends to be; and, all else being equal, the more barrel heavy and less balanced the firearm is. As a good example, the Glock 19 has a short barrel and weighs about 23 ounces. In contrast, a Glock 17L has a long six inch barrel and a commensurately long slide. To lighten the muzzle, a port about 2.25" in length is created just behind the front sight by removing a rectangular piece of steel thereby reducing the overall weight of the Glock 17L to 26-27 ounces and rebalancing the weapon so that it is not as barrel heavy.

Having one or more ports cut from the slide to reduce overall weight and to reduce barrel heaviness is an acceptable configuration in a relatively clean and safe firing environment, such as a competition or a well maintained range. However, in the field or in combat, the lightening port is an open access for water, dirt and debris to enter the slide and cause damage or outright malfunction. Thus, the Army's standard issue pistol is a shorter barrel Glock 19 with a slide that does not need a lightening port. The Army has decided to opt for shorter slides with shorter sight radii, faster draw and slower muzzle velocity over the long slide models having better accuracy and muzzle velocity. Hence, there is a need for a method or device to plug the lightening ports of the more accurate long slide firearms to prevent the entrance of dirt and debris without recreating a barrel heavy side arm. Although the concepts herein are described in the context of a Glock 9 mm semi-automatic pistol, such discussion is exemplary only for brevity and clarity and should not be understood to be limited to that particular make, model or type of weapon. The concepts discussed herein may be applicable to other makes and models of side arms as well as long guns and other larger weapons. As additional examples, the Springfield Armory XDM 5.25 and 1911-A1 Longslide also have lightening ports as does the Salient Arms Dragonfly CNC Aluminum aftermarket slide.

BRIEF SUMMARY

Devices, methods and systems are provided for plugging or filling a lightening port with an insert thereby protecting the firearm against dirt and debris entering the slide and causing damage or a malfunction. A protective insert for a lightening port having a length, a width and a vertical thickness is provided that comprises a rectangular plate having two sides and two ends. Each side and end of the plate has a length sized to allow the plate to freely ride vertically within the thickness of the port. The plate has two parallel wing walls having a length, each of the wing walls are perpendicularly attached to the underside of the plate and along a side edge of the plate. The length of each wing wall extends beyond each end of the plate and is configured to engage the underside of the slide at each end of the plate.

Other embodiments provide for protective insert for a port in a slide of a semiautomatic pistol, the port having an area and a vertical thickness. The insert comprises a plate configured to have a clearance fit within the port and having an upper surface that is flush with a top surface of the slide when installed. The insert also has two ridges protruding from the underside of the plate that extend in a direction that is collinear with the slide, wherein the plate is held within the port by a barrel of the semiautomatic pistol when the pistol when assembled.

A protective system for a semiautomatic pistol with a lightening port in its slide is also provided. The protective system comprises a barrel fixedly attached to a frame and a slide with a rectangular lightening port removed therefrom. The slide being slidingly attached to both the frame and to the barrel. The protective system also has a rectangular insert having two sides and two ends, each side and end having a length sized to allow a clearance fit within the lightening port. The rectangular insert further comprises two wing walls having a length. Each of the wing walls is perpendicularly attached to the underside of the plate and along one side of the plate, wherein the length of each wing wall extends beyond both ends of the plate and under the slide when inserted in the lightening port.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention, or the application, or uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description. Any express dimensions mentioned herein are exemplary only and are not intended to be limiting.

The subject matter herein is presented in the context of a Glock model 17L semiautomatic pistol, which is exemplary only to provide clarity and brevity. The subject matter herein is also applicable to other models of semiautomatic pistols as well and long arms and larger caliber weapons. Hence, the Glock 17L presentation context is not intended to be limiting the subject matter herein below in any manner.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. Process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

Figure 1:
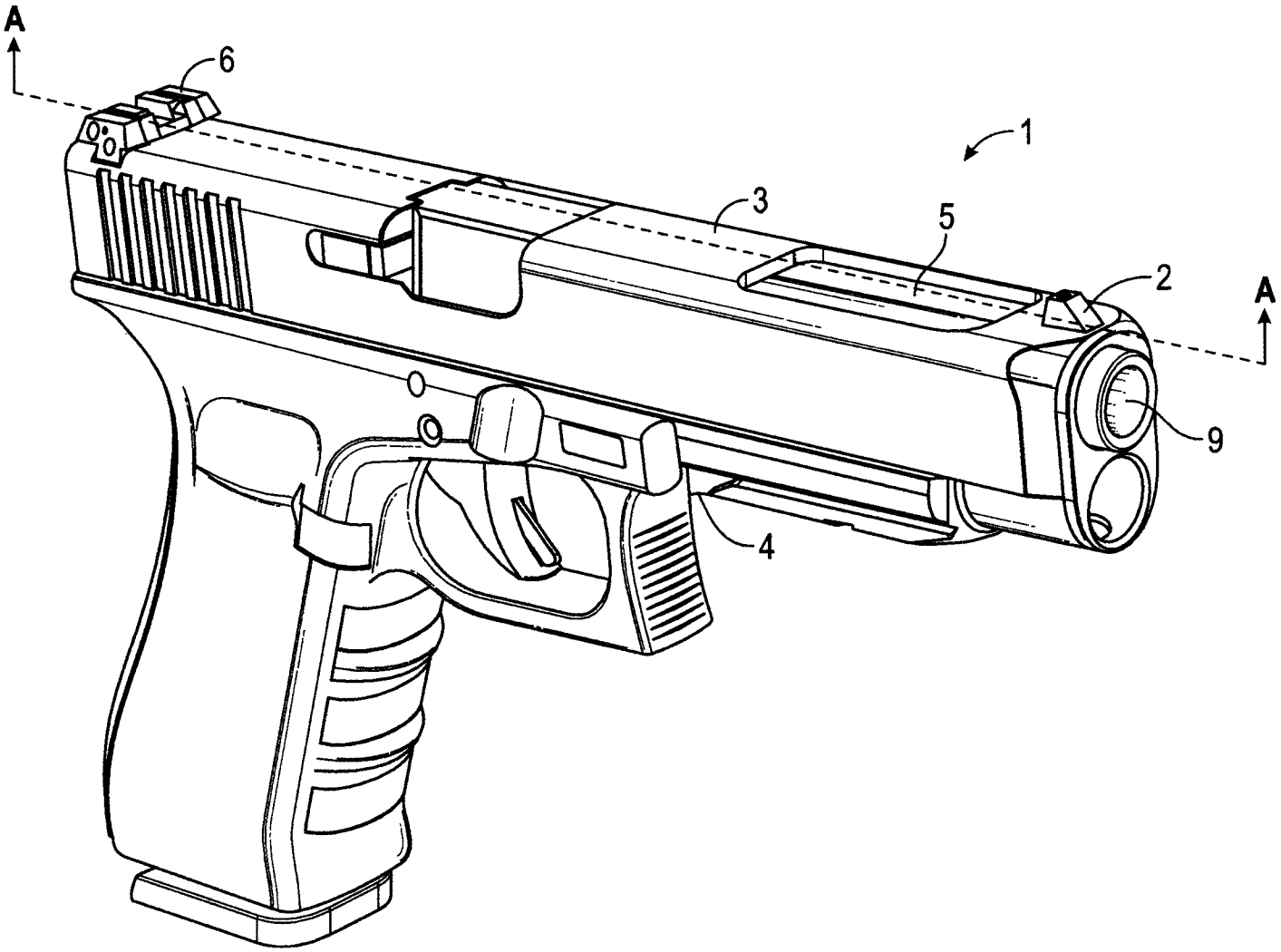
FIG. 1 is perspective view of a typical semiautomatic pistol clearly exhibiting a lightening port.

FIG. 1 is a perspective view of a Glock 34 semiautomatic pistol 1, which is an exemplary firearm having a "weight reduction" or "lightening" port 5. The exemplary pistol 1 includes a frame 4, a slide 3, a rear sight 6, a barrel 9 (see, FIG. 4), and a front sight 2. The distance from the rear sight 6 to the front sight 2 is known as the firearm's "sight radius." The lightening port 5 (or "port") is a manufacturing technique for "long slide" firearms that is used to reduce the overall weight of the firearm and to rebalance the weight so as to not make the piece "barrel heavy." Lightening ports may be of any shape such as rectangular or round.

A long slide fire arm results when a longer slide is necessary to match a longer barrel. A standard military issue Glock 19 has a four (4) inch long barrel. A short four inch barrel (and slide) makes for a lighter weapon and is a faster draw because the muzzle clears a holster sooner and faster with less effort. However, a shorter barrel reduces the range and accuracy of the bullet because the propellant gas has a shorter contact time with the bullet. Muzzle velocity is also slower.

Longer slides are commensurate with longer barrels (e.g., 6") and have the opposite advantages and disadvantages to shorter slides. Hence, removing metal mass from the muzzle end of a long slide mitigates the weight disadvantages of long slide firearms. As can be seen from FIG. 1, the port 5 of the Glock 17L is a simple rectangular cut from the top of the slide 3. Glock barrels and slides are made from carbon steel that are then treated by the Tenifer process to seal pores in the material. Carbon steel has a density of 0.284 $lb/in^3$. So a two cubic inch (2 $in^3$) removal reduces weight by about a half pound. As exemplary comparisons, carbon fiber material has a density of about 0.036 $lb/in^3$ and aluminum has a density of 0.098 $lb/in^3$.

Although the use of a lightening port is operationally acceptable in a relatively clean shooting environment, such as a gun range or in competition, the open access into the receiver is an avenue for dirt, water and debris to enter the slide that may damage or jam the firearm in a combat, law enforcement or other field environment. Thus, a means to plug or cover the lightening port is desirable.

Figure 2:
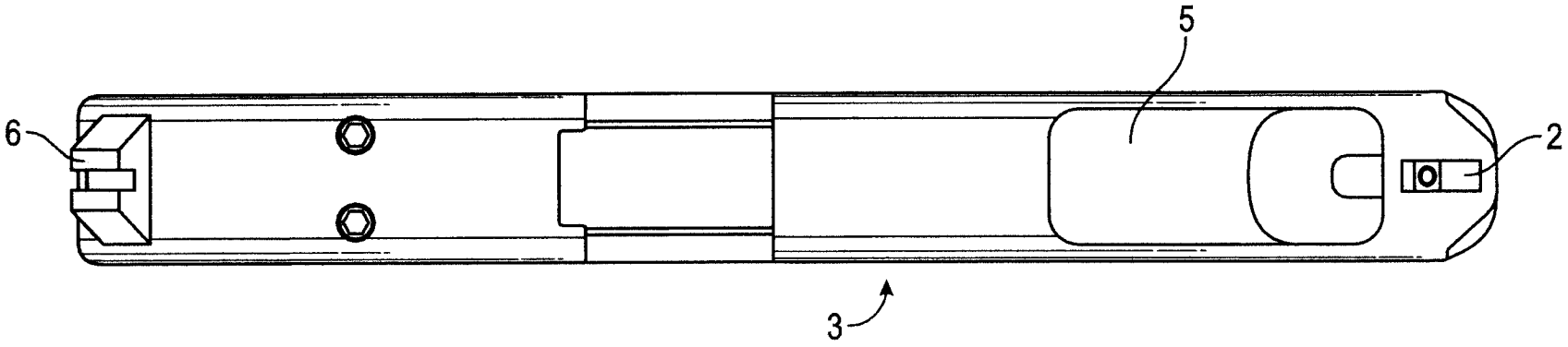
FIG. 2 is a plan view of a Glock long slide clearly showing the lightening port.
Figure 3A:
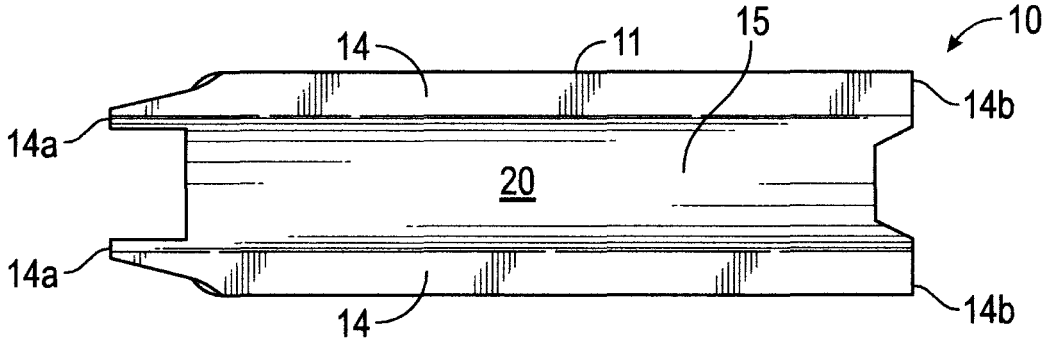
FIG. 3 is a series of orthogonal views (3A, 3B, 3C, 3D and 3E) of an exemplary protective insert.

FIG. 2 is a top view of a Glock long slide. FIG. 3 is a depiction of an exemplary embodiment of a protective insert 10 for a Glock model 17L illustrating a bottom view (FIG. 3A), a top view (FIG. 3B), end views (FIGS. 3C-D) and a side view (FIG. 3E).

Figure 3B:
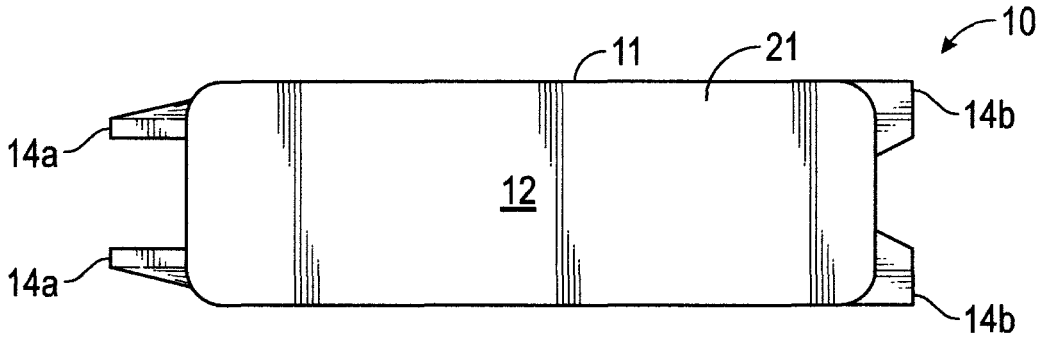
Figure 3C:
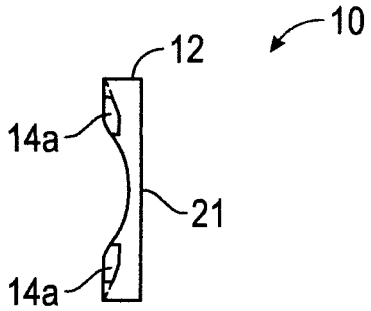
Figure 3D:
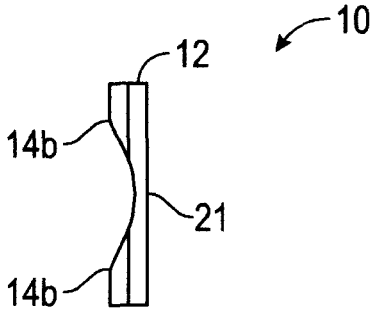
Figure 3E:
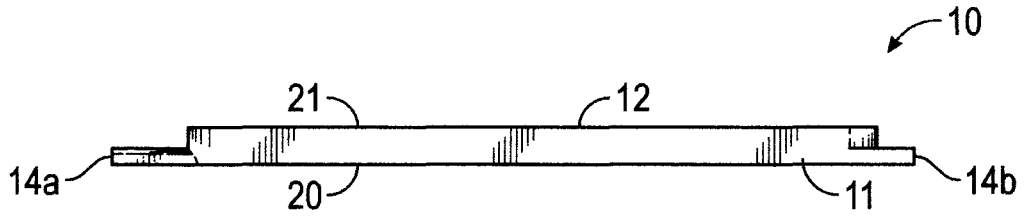

Referring to FIG. 3B, the protective insert 10 (or "insert") comprises a plate 12 of a material configured to fit into, or match, the dimensions of the port 5 with a clearance fit such that the plate 12 is able to freely float vertically in the port 5 as the slide 3 cycles. The top surface of the plate 12 essentially flush with the top surface of the slide when installed.

Referring to FIG. 3A, The plate 12 also includes two wing walls 14 or "ridges" that are each integrally and perpendicularly attached to the underside 20 of plate 12 and along each longitudinal side 11 of the plate 12. When the firearm 1 is fully assembled, the barrel 9 (See, FIG. 4) of the firearm 1 rides along the bottom surface 13 of the plate 12 and between the wing walls 14 in what may be described as a "barrel channel" 15. Because the tubular barrel 9 rides against the flat underside 20 of the plate 12 and does not contact the wing walls 14, friction is minimized and limited to a tangent line 16 running along the top of the barrel 9 (See, e.g., FIG. 4).

The wing walls 14 are of a longer length (e.g., 2.76 inches) than the length of the plate 12 (e.g., 2.25 inches) and extend forward of and behind the plate resulting in two forward extending tangs 14*a* and two rearward extending tangs 14*b*. The front and rear tangs (14*a*, 14*b*) of the wing walls 14 extend below the underside of the slide 3 when installed. The front tangs 14*a* are spaced apart laterally at a distance (e.g., 0.31") to avoid contacting the securing screw 2*a* of the front site 2 (See, FIG. 6). The front tangs 14*a* are of such a length (e.g., 0.125") and shaped (See FIG. 3C) so as to fit laterally within the slide 3 and to engage, or hook, under the bottom side of the top of the slide 3 thereby securing the front end of the plate 12 in the port 5. The front tangs may taper from an outside width at the end of plate 12 (e.g., 0.0625") to a narrower width at their tips (e.g., 0.053").

The lengths of the rear tangs 14*b* are of such a length (e.g., 0.07") to engage, or hook, under the bottom side of the top of the slide 3 thereby securing the rear of the plate in the port and to also avoid contacting any part of the frame 4 during recoil.

FIG. 3E is a side view of an embodiment of the insert 10. In some other embodiments it should be noted that the thickness of the plate 12 in other embodiments taper from back to front (e.g., 0.1"). This taper may be continuous along the length of the plate 12 or may start approximately midway between the front end and the back end of the insert topside 21.

Figure 4A:
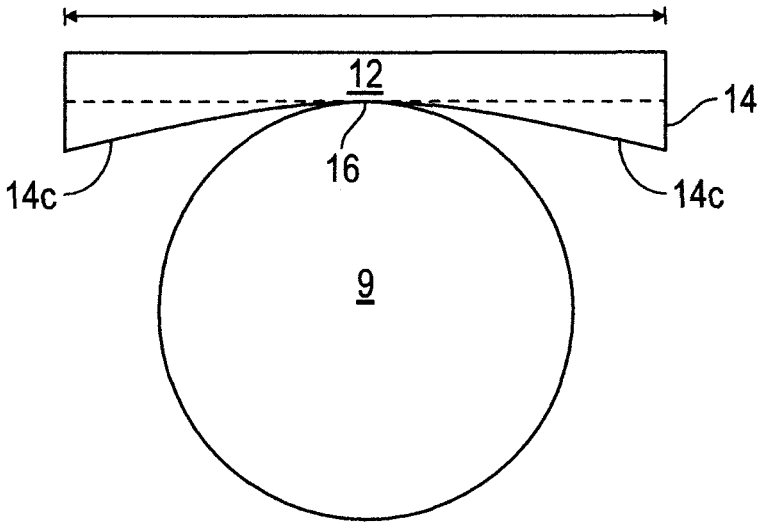
FIG. 4 is a series of cross sectional views of various embodiments of an insert in place and as supported by a barrel of a firearm.
Figure 4B:
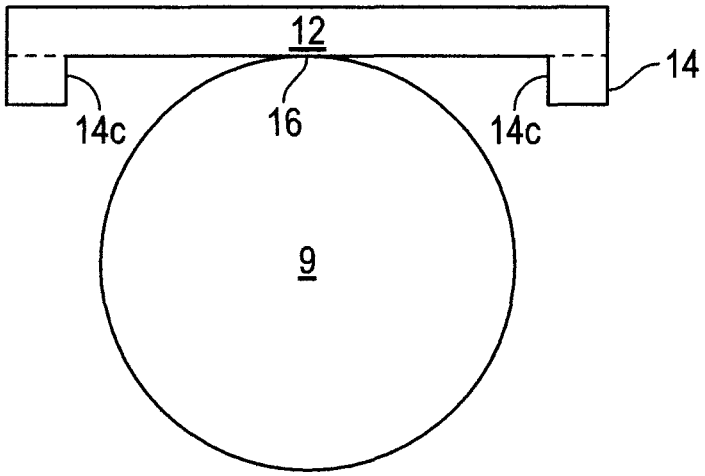
Figure 4C:
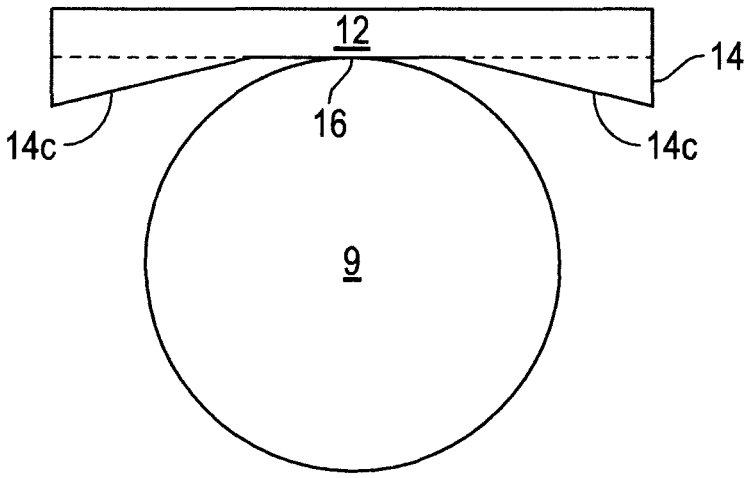

FIG. 4 depicts exemplary perspective cross sectional views of the insert 10 (e.g. width 0.75") relative to a cross section of the barrel 9 (e.g., diameter 0.59") when installed. FIG. 4*a* illustrates the perpendicular wing walls 14 with their internal sides 14*c* being curvilinear or semi-circular, in profile. Because the arc length of the curvilinear sides 14*c* is larger that the arch length of the barrel 9, the barrel contacts the insert 10 at single tangent point 16 in a cross sectional view. Thus, there is only a line of tangent points 16 (or a "friction line") located along the length of the barrel 9 that drag against the insert 10. This friction line constitutes the minimum possible area of kinetic friction drag during operation of the firearm. As additional exemplary embodiments, FIGS. 4*b* and 4*c* show the internal sides 14*c* of the wing walls 14 as being perpendicular and angular, respectively. In either case, the barrel 9 has contact only along the same minimal line of tangent as shown in FIG. 4*a*.

It is conceivable that some firearms may have a space or a distance (not shown) between the underside of the slide 3 and the barrel 9. Should that circumstance arise, the plate 12 may be made thicker to provide the line of friction. Or the interior sides 14*c* of the wing walls 14 may be reconfigured or thickened to provide two lines of friction, one along each wing wall with none along the plate 12.

Figure 5:
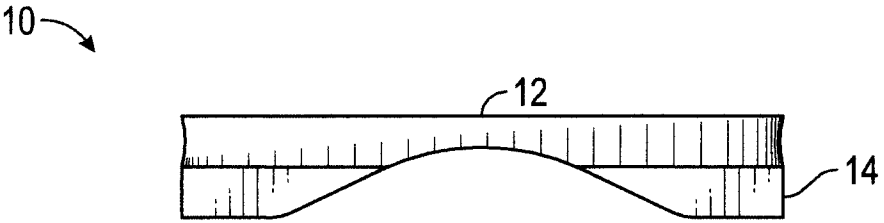
FIG. 5 is and end view of an embodiment of an insert.

FIG. 5 is a rear end view of an embodiment of the insert 10 showing the plate 12 and both wing walls 14 resulting in a semicircular "barrel channel" in the middle. Is some embodiments, the barrel channel may be tangent to the plate 12 at the channel's apex. As can be seen in the embodiment of FIG. 5 both sides are slightly tapered concavely from the slightly wider topside 21 surface where the wing walls 14 are attached to the wider bottom side 20. In other embodiments a concave taper may not be present.

The insert 10 may comprise any suitable metal (e.g., aluminum) or polymer material (e.g., carbon fiber or plastic). Preferably the material has a low coefficient of friction and a low coefficient of linear thermal expansion. A low coefficient of friction minimizes the friction drag on the barrel as discussed above. A low coefficient of linear thermal expansion ensures that the performance of the firearm is not impaired by the insert 10 if it expands and binds in the port 5 or if it warps to adversely increase the friction imparted on the barrel 9 when the barrel and slide heat up during rapid and extended use. Thus, a suitable "heat resistant material" is a material that does not expand, warp or structurally degrade at an operational heat condition (e.g., 100-300° F.). The material should also not be brittle with a relatively high Young's Modulus (E). A material is brittle, when subjected to stress, it breaks without significant plastic deformation.

Brittle materials absorb relatively little energy prior to fracture, even those of high strength. Brittleness is generally applied to materials that fail when there is little or no plastic deformation before failure. Brittle materials include most ceramics and glasses (which do not deform plastically) and some polymers, such as Polymethyl methacrylate and polystyrene. Most plastics have a very low Young's Modulus of 1.3-1.4 GPa. Glass and aluminum have relatively low Young's Moduli of 50-90 GPa and 60 GPa, respectively. Steel and carbon reinforced plastic have a moderate Young's Modulus of about 200 and 150 GPa, respectively. Graphene has a very high Young's Modulus of about 1000 GPa. A number of metals and polymers may be suitable non-brittle materials.

The coefficient of linear expansion for gunmetal is 18 $10^{-6}$ in/(in-°R). Steel is 11-12.5 in/(in-°R). The coefficient of linear expansion for some exemplary, non-limiting materials such as Graphite (i.e., carbon) and silicon have a coefficients of linear expansion of 4-8 and 3-5 $10^{-6}$ in/(in-°R), respectively. A number of metals and polymers may be suitable materials low coefficients of linear expansion.

In regard to friction, some exemplary and non-limiting examples of material combinations include steel-on aluminum that has a coefficient of static friction of 0.61, steel-on-steel is 0.7, steel-on-bronze is 0.16, steel-on-carbon is 0.14, steel-on-Teflon is 0.05, and silicon-on-steel is 0.16-0.38. A number of metals and polymer combination may be suitable materials with low coefficients of friction.

Some exemplary suitable materials that may constitute the insert 10 include but are not limited to carbon fiber composites, 7075t6 aluminum, 6061t6 aluminum, Polyethylene, or Polyurethane.

Figure 6:
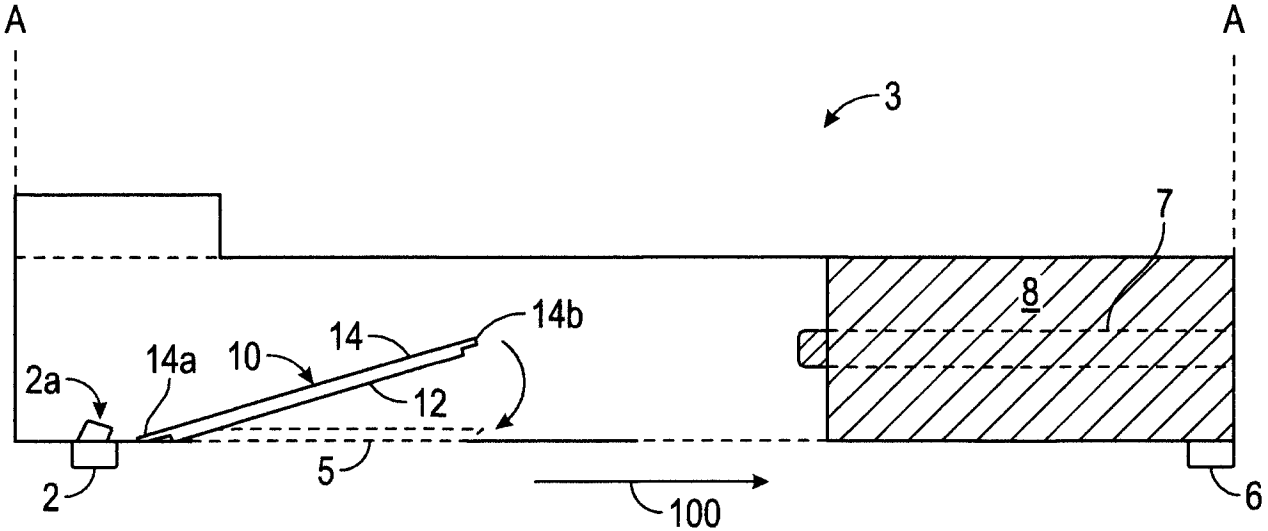
FIG. 6 is a cut away view along plane A-A in FIG. 1 showing the placement of an insert.

FIG. 6 is a cross sectional view of a slide 12 cut along line A-A shown in FIG. 1 illustrating an insert 10 when partially inserted. A front tang 14*a* is shown contacting the underside of the slide 3 near the front sight screw 2*a*. The rear tang 14*b* is shown in a pre-insertion position. As discussed above, the rear tang 14*b* is of a length to avoid contacting any part of the stationary frame 4 (including the bolt assembly 8) when the slide 3 is fully retracted in the recoil direction 100.

Figure 7:
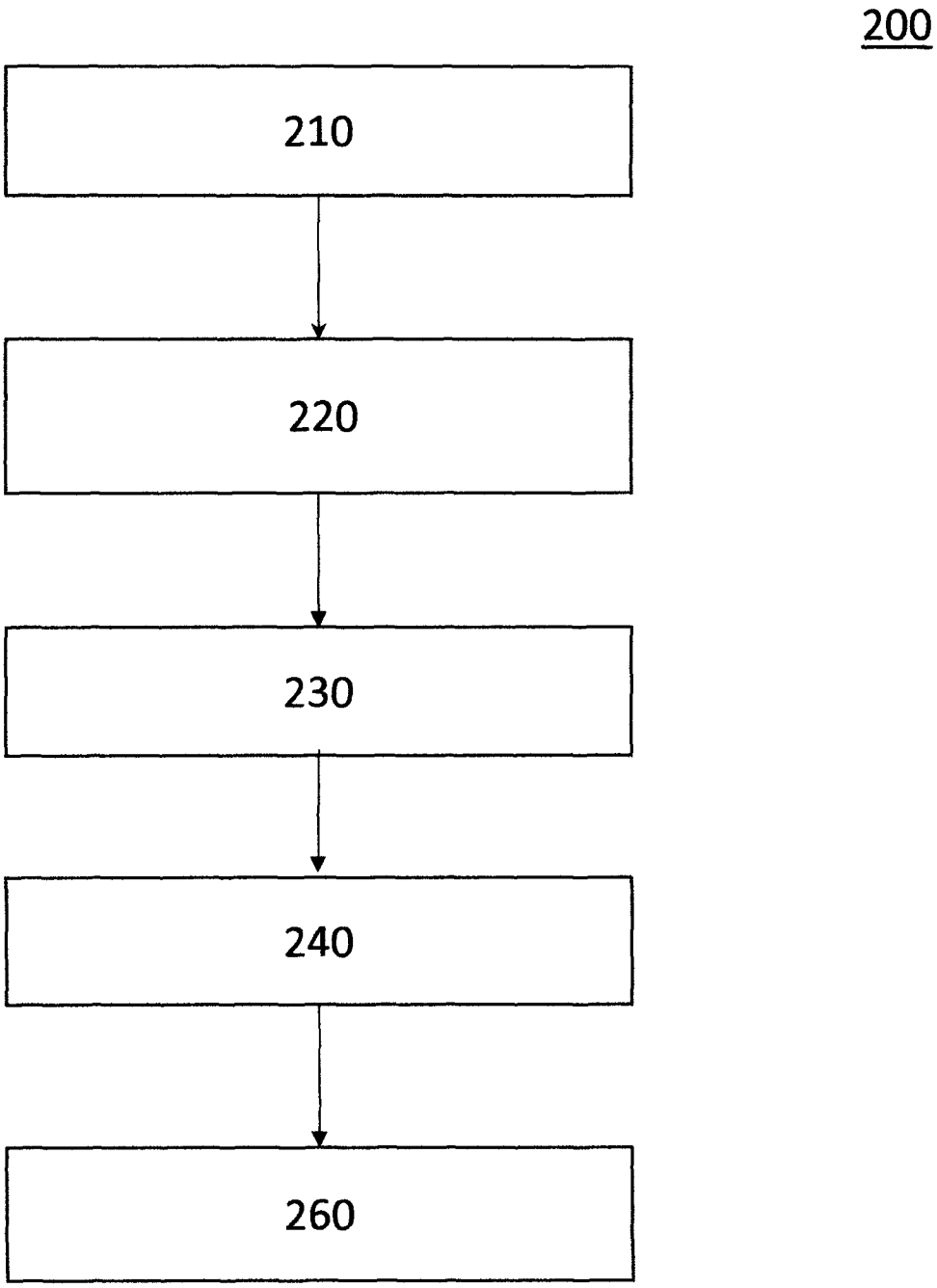
FIG. 7 is a flow block diagram illustrating how install an insert into a slide.

FIG. 7 depicts a method 200 for using the insert 10. At process 210, a user unloads and disassembles the firearm 1. At process 220, the user inverts the slide 3 of the firearm to get access to the inside of the upper side of the slide. At process 230, the user dips the front tangs 14 into the underside of the slide 3 until the tops of the tangs contact the underside of the top side of the slide 3. At process 240, the rear of the insert is then slid forward and pushed down into the lightening port 5. At process 280, firearm 1 is reassembled by inserting the barrel 9 in its normal place and the firearm is reassembled. The barrel 9 slidably holds the protective insert 10 in place against the underside of the slide 3. In other words, the insert 10 is held stationary relative to the slide 3 and moves longitudinally along the barrel 9 when the fire arm is in operation.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A protective insert for a rectangular port in a slide of a semiautomatic pistol, the port having a length, a width and a vertical thickness, the protective insert comprising:

a rectangular plate having a top side, an underside, two longitudinal sides, and two ends, each longitudinal side and each end having a length sized to allow the plate to freely ride vertically within the thickness of the port;

two parallel wing walls, each of the wing walls being perpendicularly attached to the underside of the plate and along a longitudinal side edge of the plate, wherein each wing wall extends beyond both of the plate ends and under the slide when installed.

2. The insert of claim 1, where in the insert comprises a heat resistant material.

3. The insert of claim 1, wherein the insert is made of a material with a density that is less than a density of the pistol slide.

4. The insert of claim 1, wherein the rectangular plate is secured in the rectangular port of the slide by a combination of opposing forces imparted by a barrel of the pistol and the slide against the wing walls.

5. The insert of claim 1, wherein the plate rides on a barrel of the automatic pistol.

6. The insert of claim 5, wherein the insert is made of a material that has a coefficient of static friction against steel that is less than 0.6.

7. The insert of claim 1, wherein a thickness of the plate is equal to, or more than, the thickness of the slide at the rectangular port.

8. A protective system for a firearm with a lightening port, the protective system comprising:

a barrel coupled to a frame;

a slide having the lightening port removed therefrom, the slide being slideably attached to the frame; and an insert having plate with a perimeter, the perimeter being sized to allow a clearance fit within the lightening port, the insert further comprising:

two wing walls each having a length, each of the wing walls being perpendicularly attached to the underside of the plate and parallel to each other, wherein the length of each wing wall extends beyond opposing points of the perimeter of the plate and under the slide when insert is inserted in the lightening port.

9. The protective system of claim 8, wherein the plate rides on, and is held within, the lightening port by the barrel.

10. The protective system of claim 8, wherein the material of the plate has a density that is less than the density of the slide.

11. The protective system of claim 8, wherein the material of the plate is heat resistant.

12. The protective system of claim 8, wherein the material of the plate has a coefficient of static friction in combination with that material of the barrel that is less than 0.6.

13. The protective system of claim 8, wherein the insert is comprised of one of aluminum, plastic, carbon fiber, or a polymer.

14. The protective system of claim 8, wherein the insert rides freely within the lightening port.

15. A protective insert for a port in a slide of a semiautomatic pistol, the port having an area and a vertical thickness, the insert comprising:

a plate configured to have a clearance fit within the port; and four tangs protruding from the underside of the plate that extend in a direction that is collinear with the slide, wherein the plate is held within the port by a barrel of the semiautomatic pistol pushing against the plate.

16. The protective insert of claim 15, wherein each of the four tangs are the distal ends of two wing walls perpendicularly attached to an underside of the plate.

17. The protective insert of claim 15, wherein an upper surface of the plate is flush with a top surface of the slide when installed.

18. The protective insert of claim 15, wherein the underside of the plate is flush with the underside of the slide when installed.

19. The protective insert of claim 15, wherein the port is rectangular.

20. A protective system for a semiautomatic firearm comprising:

a means for filling a lightening port in the firearm, and a means for securing the means for filling the lightening port in place when installed.

* * * * *